US010370947B1

(12) United States Patent
Artinian et al.

(10) Patent No.: US 10,370,947 B1
(45) Date of Patent: Aug. 6, 2019

(54) ARTIFICIAL LIFT

(71) Applicant: Upwing Energy, LLC, Cerritos, CA (US)

(72) Inventors: Herman Artinian, Huntingdon Beach, CA (US); Kuo-Chiang Chen, Kennedale, TX (US); Patrick McMullen, Yorba Linda, CA (US); David Biddick, Houston, TX (US)

(73) Assignee: Upwing Energy, LLC, Cerritos, CA (US)

( * ) Notice: Subject to any disclaimer, the term of this patent is extended or adjusted under 35 U.S.C. 154(b) by 0 days.

(21) Appl. No.: 16/047,983

(22) Filed: Jul. 27, 2018

(51) Int. Cl.
*E21B 43/12* (2006.01)
*E21B 41/02* (2006.01)
*E21B 33/12* (2006.01)

(52) U.S. Cl.
CPC ..... *E21B 43/128* (2013.01); *E21B 41/02* (2013.01); *E21B 33/1208* (2013.01)

(58) Field of Classification Search
CPC ..... E21B 43/128; E21B 43/121
See application file for complete search history.

(56) References Cited

U.S. PATENT DOCUMENTS 5,216,308 A * 6/1993 Meeks ..... F16C 32/0459 310/90.5
5,620,048 A 4/1997 Beauquin
6,167,965 B1 1/2001 Bearden et al.
6,557,642 B2 * 5/2003 Head ..... E21B 17/003 166/381
2001/0050173 A1 12/2001 Head
2003/0132003 A1 * 7/2003 Arauz ..... E21B 43/128 166/370
2006/0243450 A1 * 11/2006 Head ..... E21B 17/026 166/369
2007/0277969 A1 12/2007 Hall et al.
2009/0025943 A1 1/2009 Clark et al.
2009/0078426 A1 3/2009 Blaquiere
2011/0011596 A1 1/2011 Martinez et al.
2011/0021498 A1 * 1/2011 Stokes ..... C07D 401/14 514/210.21
2011/0176941 A1 7/2011 Albers et al.
2013/0043019 A1 2/2013 Hansen
2013/0341033 A1 12/2013 Carstensen et al.
2014/0020907 A1 1/2014 Head
(Continued)

OTHER PUBLICATIONS

Al-Khalifa et a., 'ESP Reliability Lessons Learned from Three H2S Saudi Arabian Fields,' Society of Petroleum Engineers, SPE-184176-MS, Nov.-Dec. 2016, 13 pages.

*Primary Examiner* — Cathleen R Hutchins
(74) *Attorney, Agent, or Firm* — Fish & Richardson P.C.

(57) ABSTRACT

A retrievable string configured to be positioned in a well is described. The retrievable string includes a rotating portion and a non-rotating portion. The rotating portion includes a rotor configured to be positioned in and driven by a stator of a well completion. The rotating portion includes an impeller coupled to the rotor. The non-rotating portion is cooperatively configured with the impeller to induce fluid flow in the well in response to the stator driving the rotor. The non-rotating portion includes a coupling part configured to support the rotor positioned in the stator. The coupling part is configured to detachably couple to a corresponding coupling part of the well completion.

27 Claims, 12 Drawing Sheets

(56) References Cited

U.S. PATENT DOCUMENTS

| | | | |
|---|---|---|---|
| 2015/0136424 | A1 | 5/2015 | Hughes et al. |
| 2015/0184487 | A1 | 7/2015 | Osborne |
| 2017/0081925 | A1 | 3/2017 | Brown et al. |
| 2017/0183935 | A1 | 6/2017 | Brown et al. |
| 2018/0045193 | A1 | 2/2018 | Tanner |
| 2018/0066479 | A1 | 3/2018 | Head et al. |

* cited by examiner

ARTIFICIAL LIFT

TECHNICAL FIELD

This disclosure relates to artificial lift systems.

BACKGROUND

Artificial lift equipment, such as electric submersible pumps, compressors, and blowers, can be used in downhole applications to increase fluid flow within a well, thereby extending the life of the well. Such equipment, however, can fail due to a number of factors. Equipment failure can sometimes require workover procedures, which can be costly. On top of this, workover procedures can include shutting in a well in order to perform maintenance on equipment, resulting in lost production. Lost production negatively affects revenue and is therefore typically avoided when possible.

SUMMARY

Certain aspects of the subject matter described here can be implemented as a retrievable string configured to be positioned in a well. The retrievable string includes a rotating portion and a non-rotating portion. The rotating portion includes a rotor configured to be positioned in and driven by a stator of a well completion. The rotating portion includes an impeller coupled to the rotor. The non-rotating portion is cooperatively configured with the impeller to induce fluid flow in the well in response to the stator driving the rotor. The non-rotating portion includes a coupling part configured to support the rotor positioned in the stator. The coupling part is configured to detachably couple to a corresponding coupling part of the well completion.

This, and other aspects, can include one or more of the following features.

The retrievable string can be configured to be exposed to production fluid from the well.

The retrievable string can be configured to allow the production fluid from the well to flow over an outer surface of the rotor.

The retrievable string can be configured to allow the production fluid from the well to flow through an inner bore of the rotor.

The retrievable string can include a connecting point positioned at an uphole end of the retrievable string. The connecting point can be configured to be connected to a connection from a surface location, allowing the retrievable string to be retrieved from the well.

The connecting point can be configured to be connected to an electrical connection to transmit signals between the surface location and a sensor of the non-rotating portion.

The rotor can include a protective sleeve surrounding the rotor. The protective sleeve can be configured to isolate the rotor from production fluid.

The protective sleeve can be non-metallic.

The protective sleeve can be metallic.

The retrievable string can include an isolation sleeve defining an outer surface of the retrievable string. The isolation sleeve can be configured to isolate production fluid flowing through the retrievable string from the stator of the well completion.

The isolation sleeve can be non-metallic.

The isolation sleeve can be metallic.

The stator can include an electromagnetic coil configured to generate a first magnetic field. The retrievable string can include a motor permanent magnet configured to cause the rotor to rotate in response to the first magnetic field generated by the electromagnetic coil.

The stator can be a first stator, and the well completion can include a second stator independently configured to drive the rotor.

The rotor can be a first rotor, and the retrievable string can include a second rotor configured to be positioned in and driven by the second stator of the well completion.

The stator can include an actuator configured to generate a second magnetic field. The retrievable string can include a bearing target configured to counteract a mechanical load on the rotor in response to the second magnetic field generated by the actuator.

The bearing target can include a bearing permanent magnet.

The bearing permanent magnet can be configured to counteract a radial load on the rotor in response to the second magnetic field generated by the actuator.

The bearing permanent magnet can be configured to counteract an axial load on the rotor in response to the second magnetic field generated by the actuator.

The actuator can include at least one of a radial bearing electromagnetic coil, a thrust bearing electromagnetic coil, a radial bearing permanent magnet, or a thrust bearing permanent magnet.

The retrievable string can include at least one of an electric submersible pump, a compressor, or a blower.

The retrievable string can include a plug positioned at the uphole end of the retrievable string. The plug can be configured to allow the retrievable string to be pumped down into the well.

The retrievable string can include a cable configured to connect to the connecting point. The cable can be configured to extend to lower the retrievable string into the well. The cable can be configured to retract to retrieve the retrievable string from the well.

The retrievable string can include a mechanical bearing configured to counteract a mechanical load of the rotor.

The mechanical bearing can be a mechanical thrust bearing configured to counteract an axial load of the rotor.

The mechanical bearing can be a mechanical radial bearing configured to counteract a radial load of the rotor.

The mechanical bearing can be exposed to production fluid from the well.

The retrievable string can include a protector. The mechanical bearing can be positioned in the protector.

The protector can include lubrication fluid and seals at opposing ends of the protector. The seals can be configured to prevent fluid from entering and exiting the protector.

The connecting point can be configured to be connected to a lubrication fluid connection to receive lubrication fluid from the surface location and replenish lubrication fluid in the protector.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes artificial lift systems. Artificial lift systems installed downhole are often exposed to hostile downhole environments. Artificial lift system failures are often related to failures in the electrical system supporting the artificial lift system. In order to avoid costly workover procedures, it can be beneficial to isolate electrical portions of such artificial lift systems to portions of a well that exhibit less hostile downhole environments in comparison to the producing portions of the well. The subject matter described in this disclosure can be implemented in particular implementations, so as to realize one or more of the following advantages. Use of such artificial lift systems can increase production from wells. In some implementations, the electrical components of the artificial lift system are separated from rotating portions of the artificial lift system, which can improve reliability in comparison to artificial lift systems where electrical systems and electrical components are integrated with both non-rotating and rotating portions. The artificial lift systems described herein can be more reliable than comparable artificial lift systems, resulting in lower total capital costs over the life of a well. The improved reliability can also reduce the frequency of workover procedures, thereby reducing periods of lost production and maintenance costs. The modular characteristic of the artificial systems described herein allows for variability in design and customization to cater to a wide range of operating conditions. The artificial lift systems described herein include a retrievable string (including the rotating components and bearing wear components of the system) which can be removed from the well simply and quickly. A replacement retrievable string can then be installed quickly to minimize lost production, thereby reducing replacement costs and reducing lost production over the life of a well.

Figure 1:
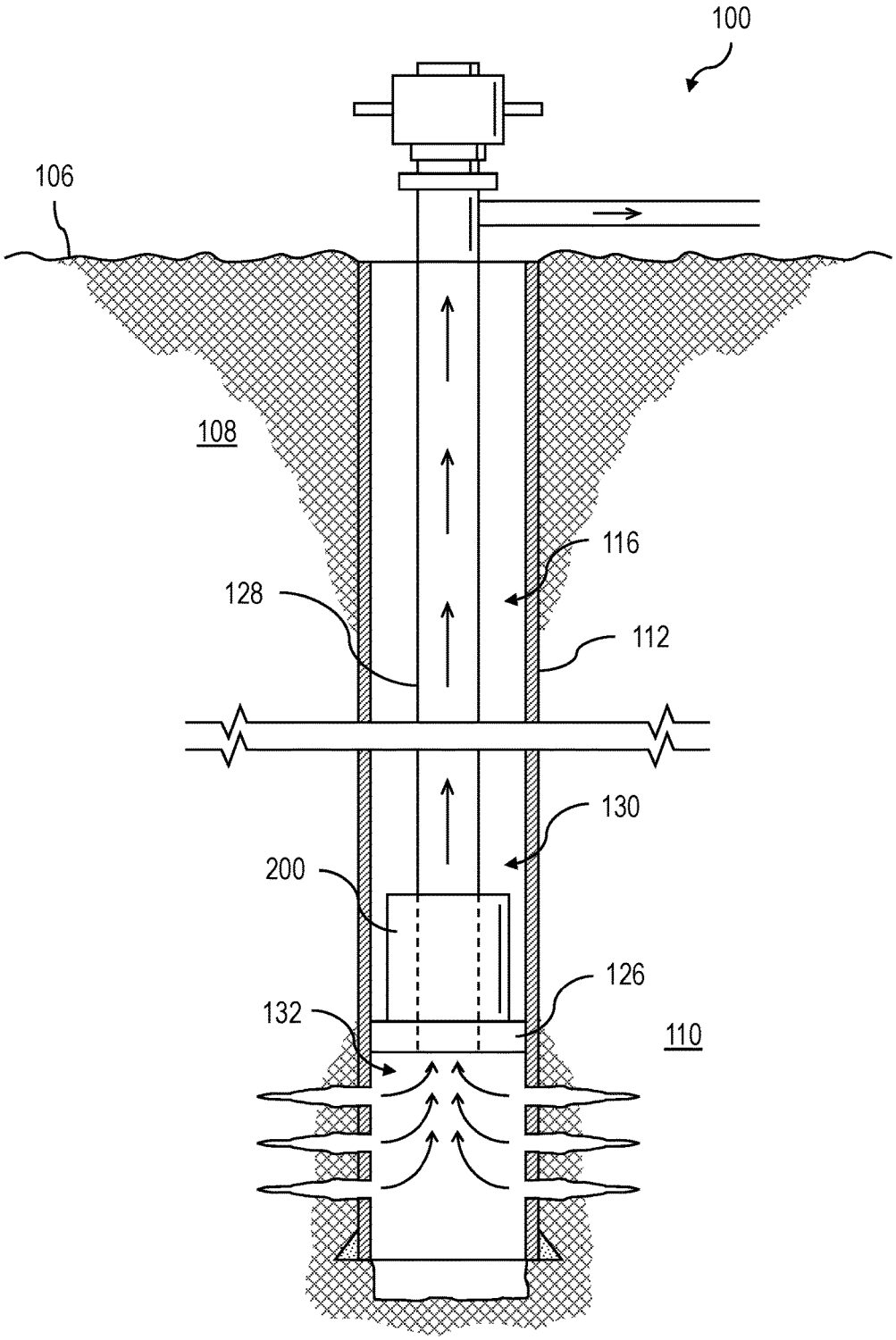
FIG. 1 is a schematic diagram of an example well.

FIG. 1 depicts an example well 100 constructed in accordance with the concepts herein. The well 100 extends from the surface 106 through the Earth 108 to one more subterranean zones of interest 110 (one shown). The well 100 enables access to the subterranean zones of interest 110 to allow recovery (that is, production) of fluids to the surface 106 (represented by flow arrows in FIG. 1) and, in some implementations, additionally or alternatively allows fluids to be placed in the Earth 108. In some implementations, the subterranean zone 110 is a formation within the Earth 108 defining a reservoir, but in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other suitable types of formations, including reservoirs that are not naturally fractured in any significant amount. For simplicity's sake, the well 100 is shown as a vertical well, but in other instances, the well 100 can be a deviated well with a wellbore deviated from vertical (for example, horizontal or slanted) and/or the well 100 can include multiple bores, forming a multilateral well (that is, a well having multiple lateral wells branching off another well or wells).

In some implementations, the well 100 is a gas well that is used in producing natural gas from the subterranean zones of interest 110 to the surface 106. While termed a "gas well," the well need not produce only dry gas, and may incidentally or in much smaller quantities, produce liquid including oil and/or water. In some implementations, the well 100 is an oil well that is used in producing crude oil from the subterranean zones of interest 110 to the surface 106. While termed an "oil well,": the well not need produce only crude oil, and may incidentally or in much smaller quantities, produce gas and/or water. In some implementations, the production from the well 100 can be multiphase in any ratio, and/or can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources, and/or could be used in injection wells, disposal wells, or other types of wells used in placing fluids into the Earth.

The wellbore of the well 100 is typically, although not necessarily, cylindrical. All or a portion of the wellbore is lined with a tubing, such as casing 112. The casing 112 connects with a wellhead at the surface 106 and extends downhole into the wellbore. The casing 112 operates to isolate the bore of the well 100, defined in the cased portion of the well 100 by the inner bore 116 of the casing 112, from the surrounding Earth 108. The casing 112 can be formed of a single continuous tubing or multiple lengths of tubing joined (for example, threadedly and/or otherwise) end-to-end of the same size or of different sizes. In FIG. 1, the casing 112 is perforated in the subterranean zone of interest 110 to allow fluid communication between the subterranean zone of interest 110 and the bore 116 of the casing 112. In some implementations, the casing 112 is omitted or ceases in the region of the subterranean zone of interest 110. This portion of the well 100 without casing is often referred to as "open hole."

The wellhead defines an attachment point for other equipment to be attached to the well 100. For example, FIG. 1 shows well 100 being produced with a Christmas tree attached the wellhead. The Christmas tree includes valves used to regulate flow into or out of the well 100. The well 100 also includes an artificial lift system 200 residing in the wellbore, for example, at a depth that is nearer to subterranean zone 110 than the surface 106. The system 200, being of a type configured in size and robust construction for installation within a well 100, can include any type of rotating equipment that can assist production of fluids to the surface 106 and out of the well 100 by creating an additional pressure differential within the well 100. For example, the system 200 can include a pump, compressor, blower, or multi-phase fluid flow aid.

In particular, casing 112 is commercially produced in a number of common sizes specified by the American Petroleum Institute (the "API), including 4½, 5, 5½, 6, 6⅝, 7, 7⅝, 16/8, 9⅝, 10¾, 11¾, 13⅜, 16, 116/8 and 20 inches, and the API specifies internal diameters for each casing size. The system 200 can be configured to fit in, and (as discussed in more detail below) in certain instances, seal to the inner diameter of one of the specified API casing sizes. Of course, the system 200 can be made to fit in and, in certain instances, seal to other sizes of casing or tubing or otherwise seal to a wall of the well 100.

Additionally, the construction of the components of the system 200 are configured to withstand the impacts, scraping, and other physical challenges the system 200 will encounter while being passed hundreds of feet/meters or even multiple miles/kilometers into and out of the well 100. For example, the system 200 can be disposed in the well 100 at a depth of up to 20,000 feet (6,096 meters). Beyond just a rugged exterior, this encompasses having certain portions of any electrical components being ruggedized to be shock resistant and remain fluid tight during such physical challenges and during operation. Additionally, the system 200 is configured to withstand and operate for extended periods of time (e.g., multiple weeks, months or years) at the pressures and temperatures experienced in the well 200, which temperatures can exceed 400° F./205° C. and pressures over 2,000 pounds per square inch, and while submerged in the well fluids (gas, water, or oil as examples). Finally, the system 200 can be configured to interface with one or more of the common deployment systems, such as jointed tubing (that is, lengths of tubing joined end-to-end, threadedly and/or otherwise), sucker rod, coiled tubing (that is, not-jointed tubing, but rather a continuous, unbroken and flexible tubing formed as a single piece of material), slickline (that is, a single stranded wire), or wireline with an electrical conductor (that is, a monofilament or multifilament wire rope with one or more electrical conductors, sometimes called e-line) and thus have a corresponding connector (for example, a jointed tubing connector, coiled tubing connector, or wireline connector). Some components of the system 200 (such as non-rotating parts and electrical systems, assemblies, and components) can be parts of or attached to the production tubing 128 to form a portion of the permanent completion, while other components (such as rotating parts) can be deployed within the production tubing 128.

A seal system 126 integrated or provided separately with a downhole system, as shown with the system 200, divides the well 100 into an uphole zone 130 above the seal system 126 and a downhole zone 132 below the seal system 126. FIG. 1 shows the system 200 positioned in the open volume of the bore 116 of the casing 112, and connected to a production string of tubing (also referred as production tubing 128) in the well 100. The wall of the well 100 includes the interior wall of the casing 112 in portions of the wellbore having the casing 112, and includes the open hole wellbore wall in uncased portions of the well 100. Thus, the seal system 126 is configured to seal against the wall of the wellbore, for example, against the interior wall of the casing 112 in the cased portions of the well 100 or against the interior wall of the wellbore in the uncased, open hole portions of the well 100. In certain instances, the seal system 126 can form a gas- and liquid-tight seal at the pressure differential the system 200 creates in the well 100. For example, the seal system 126 can be configured to at least partially seal against an interior wall of the wellbore to separate (completely or substantially) a pressure in the well 100 downhole of the seal system 126 from a pressure in the well 100 uphole of the seal system 126. For example, the seal system 126 includes a production packer. Although not shown in FIG. 1, additional components, such as a surface compressor, can be used in conjunction with the system 200 to boost pressure in the well 100.

In some implementations, the system 200 can be implemented to alter characteristics of a wellbore by a mechanical intervention at the source. Alternatively, or in addition to any of the other implementations described in this specification, the system 200 can be implemented as a high flow, low pressure rotary device for gas flow in sub-atmospheric wells. Alternatively, or in addition to any of the other implementations described in this specification, the system 200 can be implemented in a direct well-casing deployment for production through the wellbore. Other implementations of the system 200 as a pump, compressor, or multiphase combination of these can be utilized in the well bore to effect increased well production.

The system 200 locally alters the pressure, temperature, and/or flow rate conditions of the fluid in the well 100 proximate the system 200. In certain instances, the alteration performed by the system 200 can optimize or help in optimizing fluid flow through the well 100. As described previously, the system 200 creates a pressure differential within the well 100, for example, particularly within the locale in which the system 200 resides. In some instances, a pressure at the base of the well 100 is a low pressure (for example, sub-atmospheric); so unassisted fluid flow in the wellbore can be slow or stagnant. In these and other instances, the system 200 introduced to the well 100 adjacent the perforations can reduce the pressure in the well 100 near the perforations to induce greater fluid flow from the subterranean zone 110, increase a temperature of the fluid entering the system 200 to reduce condensation from limiting production, and/or increase a pressure in the well 100 uphole of the system 200 to increase fluid flow to the surface 106.

The system 200 moves the fluid at a first pressure downhole of the system 200 to a second, higher pressure uphole of the system 200. The system 200 can operate at and maintain a pressure ratio across the system 200 between the second, higher uphole pressure and the first, downhole pressure in the wellbore. The pressure ratio of the second pressure to the first pressure can also vary, for example, based on an operating speed of the system 200.

The system 200 can operate in a variety of downhole conditions of the well 100. For example, the initial pressure within the well 100 can vary based on the type of well, depth of the well 100, production flow from the perforations into the well 100, and/or other factors. In some examples, the pressure in the well 100 proximate a bottomhole location is sub-atmospheric, where the pressure in the well 100 is at or below about 14.7 pounds per square inch absolute (psia), or about 101.3 kiloPascal (kPa). The system 200 can operate in sub-atmospheric well pressures, for example, at well pressure between 2 psia (13.8 kPa) and 14.7 psia (101.3 kPa). In some examples, the pressure in the well 100 proximate a bottomhole location is much higher than atmospheric, where the pressure in the well 100 is above about 14.7 pounds per square inch absolute (psia), or about 101.3 kiloPascal (kPa). The system 200 can operate in above atmospheric well pressures, for example, at well pressure between 14.7 psia (101.3 kPa) and 5,000 psia (34,474 kPa).

Figure 2:
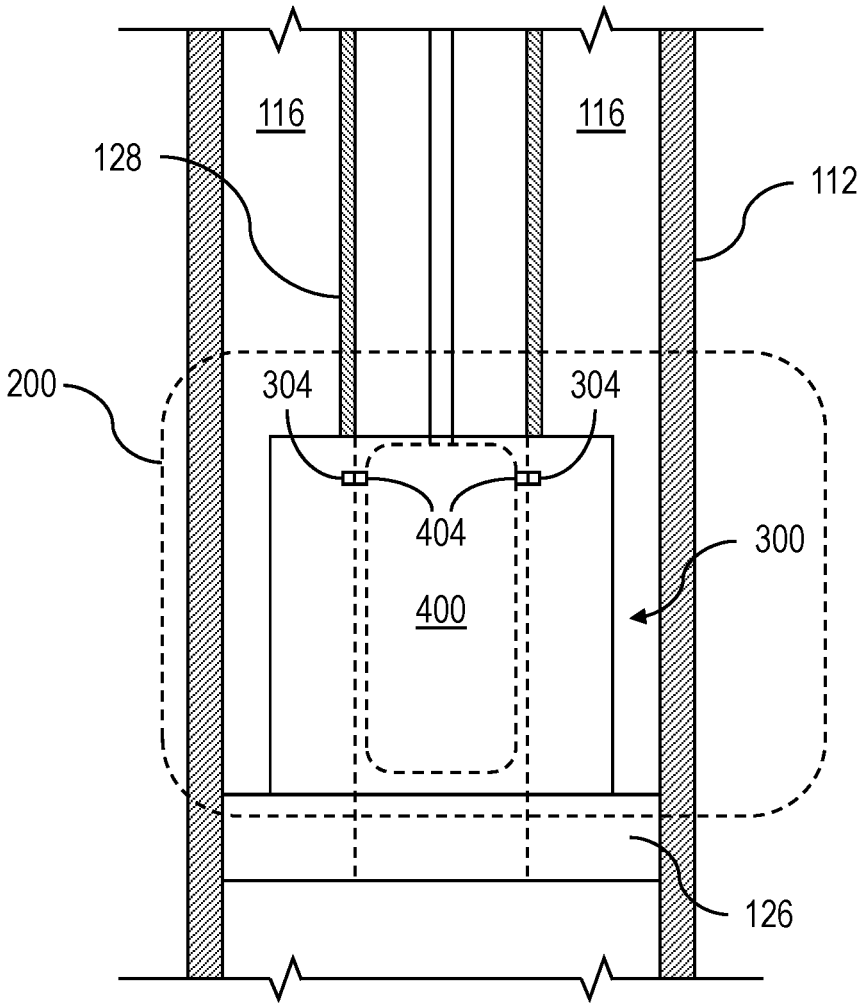
FIG. 2 is a schematic diagram of an example system within the well of FIG. 1.

Referring to FIG. 2, the system 200 includes a subsystem 300 and a retrievable string 400. The subsystem 300 is installed as a portion of a completion string of the well 100. In some instances, the subsystem 300 is referred as the well completion in this disclosure. In some implementations, the subsystem 300 (in part or in whole) is part of the casing and can be cemented in place within the well 100. The subsystem 300 can be connected to the seal system 126 (for example, a production packer) and the production tubing 128, to form a part of the completion string of the well 100. The retrievable string 400 can be configured to interface with one or more of the common deployment systems described previously (for example, slickline), such that the retrievable string 400 can be deployed downhole into the well 100. At least a portion of the retrievable string 400 can be positioned within the subsystem 300. In some implementations, the entire retrievable string 400 can be positioned within the subsystem 300. The subsystem 300 and the retrievable string 400 each include corresponding coupling parts (304 and 404, respectively) that are cooperatively configured to couple the retrievable string 400 and the subsystem 300 to each other. Coupling the corresponding coupling parts (304 and 404) together can secure the relative positions of the subsystem 300 and the retrievable string 400 to each other. The subsystem 300 and the retrievable string 400 are detachably coupled to each other via the corresponding coupling parts (304, 404)—that is, the subsystem 300 and the retrievable string 400 can subsequently be decoupled and detached from each other.

The subsystem 300 includes a stator 302 (described later), which can attach to a tubing of the completion string (such as the production tubing 128). The retrievable string 400 includes a rotor 402 (described later). While the retrievable string 400 is coupled to the subsystem 300, the stator 302 is configured to drive the rotor 402 in response to receiving power. In some implementations, the electrical components are part of the stator 302 of the subsystem 300, while the retrievable string 400 is free of electrical components. In some implementations, the subsystem 300 is free of rotating components.

Figure 3:
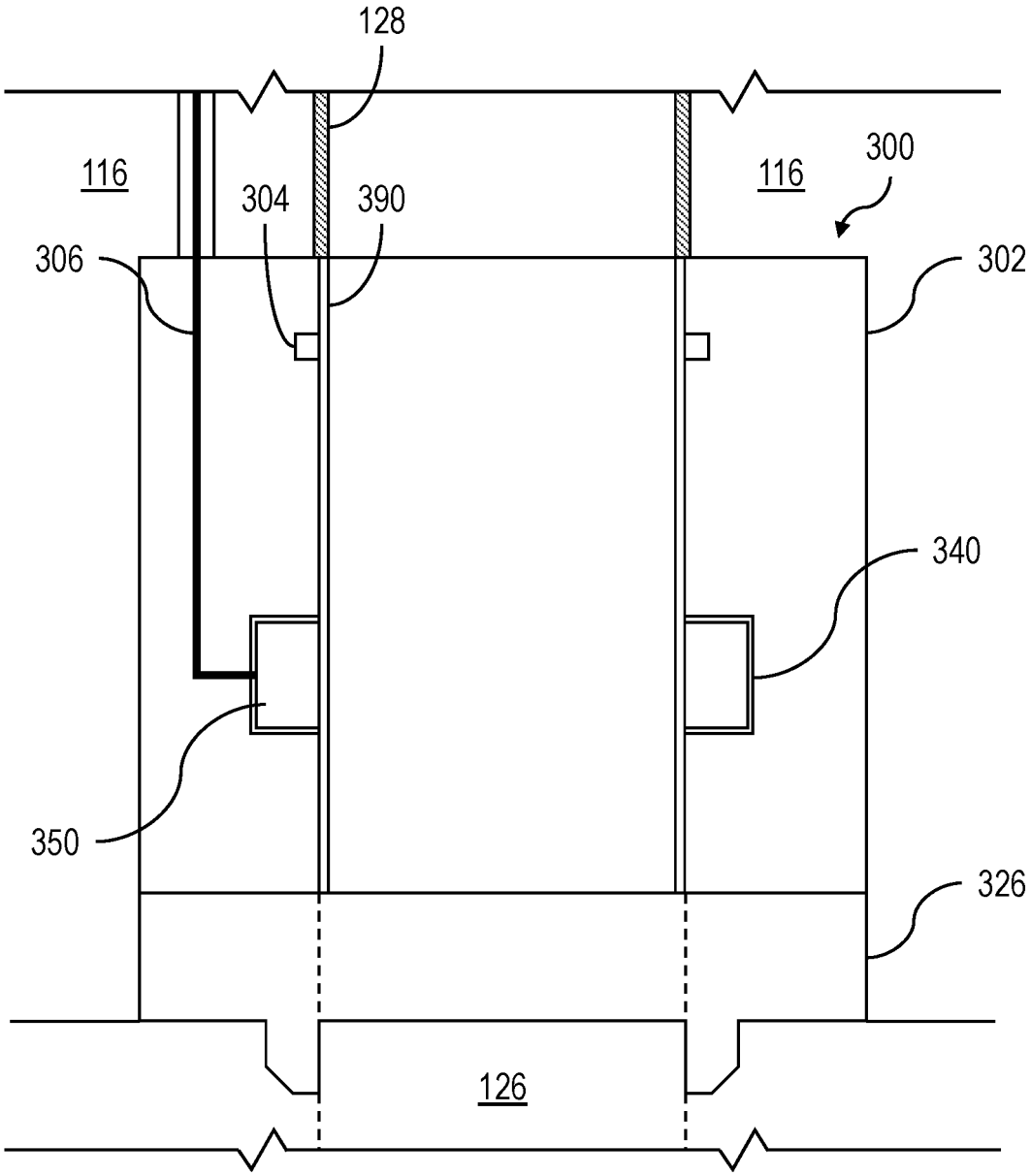
FIG. 3 is a schematic diagram of an example stator of the system of FIG. 2.

Referring to FIG. 3, the subsystem 300 can include an electrical connection 306, a seal 326, and an electromagnetic coil 350. Although described as separate components, a conglomerate of various components of the subsystem 300 can be referred as the stator 302. For example, the stator 302 is sometimes referenced in this disclosure as including the seal 326 and the electromagnetic coil 350. The stator 302 has an inner surface defined by an inner diameter, and the stator 302 can define a chamber 340 formed on the inner surface. The chamber 340 can house the electromagnetic coil 350. The stator 302 can include a protective sleeve 390 that is configured to attach to the production tubing 128. The protective sleeve 390 can be configured to isolate the chamber 340 from production fluid (that is, fluid produced from the subterranean zone 110). The protective sleeve 390 can be metallic or non-metallic. The protective sleeve 390 can be made of a material suitable for the environment and operating conditions (for example, downhole conditions). For example, the protective sleeve 390 can be made of carbon fiber or Inconel. The protective sleeve 390 can serve a similar purpose as the production tubing 128, that is, isolating the casing from production fluid, while also allowing magnetic flux to penetrate from the stator 302, through the sleeve 390, and into the inner space of the production tubing 128. The protective sleeve 390 can be a part of (that is, integral to) the production tubing 128 or can be attached to the production tubing 128.

The electrical connection 306 is connected to the electromagnetic coil 350. The electrical connection 306 can include a cable positioned in an annulus, such as the inner bore 116 between the casing 112 and the production tubing 128. The annulus can be filled with completion fluid, and the completion fluid can include a corrosion inhibitor in order to provide protection against corrosion of the electrical connection 306. The electrical connection 306 can be connected to a power source located within the well 500 or at the surface 106 via the cable to supply power to the electromagnetic coil 350. The electrical connection 306 can be connected to the chamber 340 and can be configured to prevent fluid from entering and exiting the chamber 340 through the electrical connection 306. The electrical connection 306 can be used to supply power and/or transfer information. Although shown as having one electrical connection 306, the subsystem 300 can include additional electrical connections.

The seal 326 can be positioned at a downhole end of the subsystem 300. The seal 326 can be configured to directly or indirectly connect to a production packer disposed in the well downhole of the stator 302 (such as the production packer 126 disposed in the well 100), in order to isolate an annulus between the stator 302 and the well 100 (such as the inner bore 116 between the casing 112 and the stator 302) from a producing portion of the well 100 downhole of the annulus (for example, the downhole zone 132). In some implementations, the seal 326 is a seal stack that is configured to connect to (for example, stab into) a polished bore receptacle connected to the production packer 126 in order to form a pressure-tight barrier.

In some implementations, the subsystem 300 includes additional components (such as a thrust bearing actuator 352 and/or a radial bearing actuator 354, described later), and the chamber 340 can house the additional components. In some implementations, the stator 302 defines one or more additional chambers (separate from the chamber 340) which can house any additional components. In some implementations, the subsystem 300 includes one or more sensors which can be configured to measure one or more properties (such as a property of the well 100, a property of the stator 302, and a property of the retrievable string 400). Some non-limiting examples of properties that can be measured by the one or more sensors are pressure (such as downhole pressure), temperature (such as downhole temperature or temperature of the stator 302), fluid flow (such as production fluid flow), fluid properties (such as viscosity), fluid composition, a mechanical load (such as an axial load or a radial load), and a position of a component (such as an axial position or a radial position of the rotor 402).

In some implementations, the subsystem 300 includes a cooling circuit (380, an example shown in FIG. 5) configured to remove heat from the stator 302. The cooling circuit 380 can include a coolant that is provided from a topside of the well 100 (for example, a location at the surface 106), for example, through a tube located in the annulus 116 between the casing 112 and the production tubing 128. The coolant can enter the stator 302 through a sealed port and flow through the stator 302 to remove heat from the stator 302. In some implementations, the cooling circuit 380 circulates coolant within the subsystem 300 to remove heat from various components (or a heat sink) of the subsystem 300. In some implementations, the cooling circuit 380 can also provide cooling to the electrical connection 306. For example, the cooling circuit 380 can run through the annulus 116 between the casing 112 and the production tubing 128 along (or in the vicinity of) the electrical connection 306. In some implementations, the cooling circuit 380 circulates coolant within portions of the subsystem 300 where heat dissipation to the production fluid is limited. The cooling circuit 380 can circulate coolant within the subsystem 300 to lower the operating temperature of the subsystem 300 (which can extend the operating life of the subsystem 300), particularly when the surrounding temperature of the environment would otherwise prevent the subsystem 300 from meeting its intended operating life. Some non-limiting examples of components that can benefit from cooling by the cooling circuit 380 are the electromagnetic coil 350 and any other electrical components. In some implementations, the cooling circuit 380 includes a jacket 384 positioned within the stator 302 through which the coolant can circulate to remove heat from the stator 302 and/or other components of the subsystem 300. In some implementations, the jacket 384 is in the form of tubing or a coil positioned within the stator 302 through which the coolant can circulate to remove heat from the stator 302 and/or other components of the subsystem 300. As such, the coolant can be isolated within the cooling circuit 380 by the jacket 384 and not directly interact with other components of the subsystem 300. That is, the other components of the subsystem 300 (such as electromagnetic coil 350) are not flooded by the coolant of the cooling circuit 380.

The coolant circulating through the cooling circuit 380 can be pressurized. The pressurized coolant circulating through the cooling circuit 380 can provide various benefits, such as supporting the protective sleeve 390 and reducing the differential pressure (and in some cases, equalizing the pressure) across the stator 302 between the cooling circuit 380 and the surrounding environment of the stator 302. In some implementations, the cooling circuit 380 includes an injection valve 382, which can be used to inject coolant into the production fluid. The coolant can include additives, such as scale inhibitor and wax inhibitor. The coolant including scale and/or wax inhibitor can be injected into the production fluid using the injection valve 382 in order to mitigate, minimize, or eliminate scaling and/or paraffin wax buildup in the well 100.

In some implementations, the subsystem 300 includes additional components or duplicate components (such as multiple stators 302) that can act together or independently to provide higher output or redundancy to enhance long term operation. In some implementations, the subsystem 300 is duplicated one or more times to act together with other subsystems to provide higher output or independently for redundancy. The presence of multiple subsystems 300 can enhance long term operation. In some implementations (for example, where multiple subsystems 300 operate in conjunction to provide higher well output), each additional or duplicate subsystem 300 can operate with different retrievable strings. In some implementations (for example, where multiple subsystems 300 operate independently for redundancy), each additional or duplicate subsystem 300 can operate with a single retrievable string (such as the retrievable string 400), which can be relocated within the well depending on whichever subsystem the retrievable string is operating with to provide well output.

Figure 4:
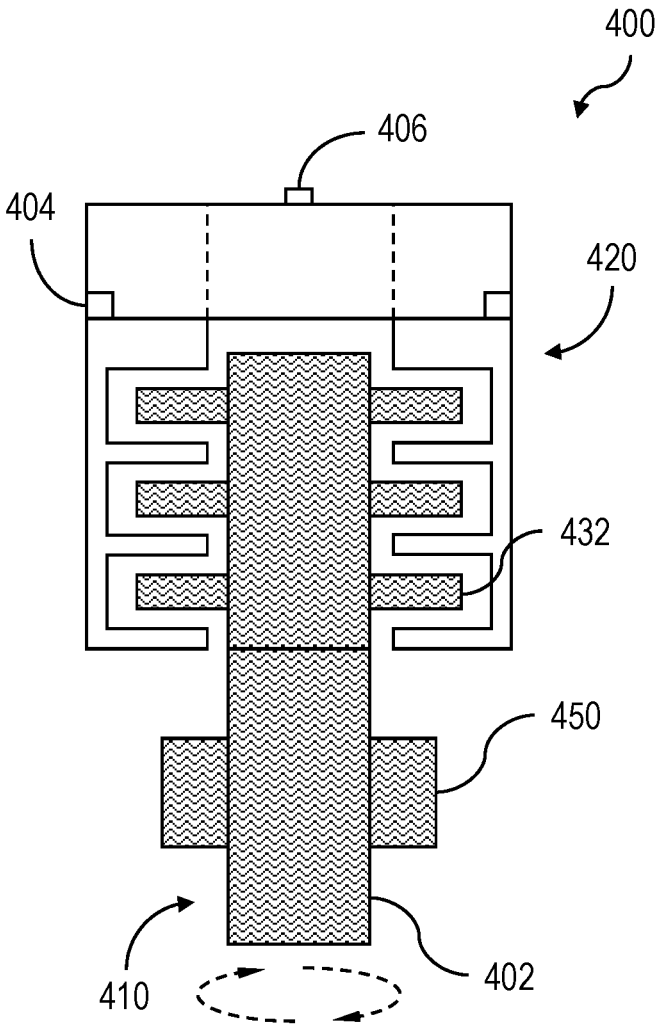
FIG. 4 is a schematic diagram of an example retrievable string of the system of FIG. 2.

Referring to FIG. 4, the retrievable string 400 includes a rotating portion 410 and a non-rotating portion 420. The rotating portion 410 includes the rotor 402, and the non-rotating portion 420 includes the coupling part 404. In response to receiving power, the electromagnetic coil 350 of the subsystem 300 can be configured to generate a magnetic field to engage a motor permanent magnet 450 of the retrievable string 400 and cause the rotor 402 to rotate. The electromagnetic coil 350 and the motor permanent magnet 450 interact magnetically. The electromagnetic coil 350 and the motor permanent magnet 450 each generate magnetic fields which attract or repel each other. The attraction or repulsion imparts forces that cause the rotor 402 to rotate. The subsystem 300 and the retrievable string 400 can be designed such that corresponding components are located near each other when the retrievable string 400 is positioned in the subsystem 300. For example, when the retrievable string 400 is positioned in the subsystem 300, the electromagnetic coil 350 is in the vicinity of the motor permanent magnet 450. As one example, the electromagnetic coil 350 is constructed similar to a permanent magnet motor stator, including laminations with slots filled with coil sets constructed to form three phases with which a produced magnetic field can be sequentially altered to react against a motor permanent magnetic field and impart torque on a motor permanent magnet, thereby causing the rotor 402 to rotate.

The retrievable string 400 is configured to be positioned in a well (such as the well 100). The rotor 402 of the retrievable string 400 is configured to be positioned in and driven by a stator of a well completion (such as the stator 302). The retrievable string 400 includes at least one impeller 432 coupled to the rotor 402. The non-rotating portion 420 of the retrievable string 400 and the impeller 432 are cooperatively configured to induce fluid flow in the well 100 in response to the stator 302 driving the rotor 402. The coupling part 404 is configured to support the rotor 402 positioned in the stator 302 and can detachably couple to the corresponding coupling part 304 of the well completion (subsystem 300).

The retrievable string 400 can include a connecting point 406, a motor permanent magnet 450, and a protective sleeve 490. The connecting point 406 can be positioned at an uphole end of the retrievable string 400. The connecting point 406 can be configured to be connected to a connection from a location at the surface 106 (for example, by slickline), allowing the retrievable string 400 to be deployed in the well 100 and, additionally or alternatively, retrieved from the well 100 after the retrievable string 400 has been decoupled from the subsystem 300. In some implementations, the retrievable string 400 includes a cable (such as a slickline, wireline, or coiled tubing) configured to connect to the connecting point 406. The cable can extend to lower the retrievable string 400 into the well 100 and retract to retrieve the retrievable string 400 from the well 100. In some implementations, once the retrievable string 400 is installed in the well 100, the cable can be disconnected from the retrievable string 400 and retrieved from the well 100, so that the cable is not hanging within the production tubing 128 while the well 100 is producing. In some implementations, the retrievable string 400 includes a plug in addition to or instead of the connecting point 406. The plug can be positioned at the uphole end of the retrievable string 400 and can be configured to allow the retrievable string 400 to be pumped down into the well. For example, the plug can be a low pressure seal, and fluidic pressure can be applied on top of the plug in order to push the retrievable string 400 down into the well 100. The connecting point 406 can be configured to be connected by an electrical connection, which can be used to transfer signals to and from a location at the surface 106. For example, one or more sensors of the non-rotating portion 420 can transmit signals to and from a location at the surface 106 through the electrical connection connected to the connecting point 406. In some implementations, the connecting point 406 can be configured to be connected to a tube to receive fluid from a location at the surface 106. For example, the connecting point 406 can be connected to a lubrication fluid connection to receive lubrication fluid from a location at the surface 106 in order to replenish lubrication fluid in a protector (described later) of the retrievable string 400.

The motor permanent magnet 450 is configured to cause the rotor 402 to rotate in response to the magnetic field generated by the electromagnetic coil 350 of the stator 302. The retrievable string 400 can include at least one of an electric submersible pump, a compressor, or a blower. For example, the rotating portion 410 includes the impellers 432 and central rotating shaft of an electric submersible pump, while the non-rotating portion 420 includes the diffuser and/or housing of the electric submersible pump. The retrievable string 400 can be exposed to production fluid from the subterranean zone 110. In some implementations, the retrievable string 400 includes a protector (described later) configured to protect a portion of the rotor 402 against contamination of production fluid. In some implementations, the retrievable string 400 can allow production fluid from the subterranean zone 110 to flow over an outer surface of the rotor 402. In some implementations, production fluid from the subterranean zone 110 flows through the annulus defined between the outer surface of the rotor 402 and the inner surface of the stator 302 (or the protective sleeve 390). In some implementations, production fluid from the subterranean zone 110 can flow through an inner bore of the rotor 402.

The non-rotating portion 420 of the retrievable string 400 can also include a recirculation isolator that is configured to create a seal between the non-rotating portion 420 and the subsystem 300. By creating the seal between the non-rotating portion 420 and the subsystem 300, the recirculation isolator can force produced fluid to flow through the space between the impellers 432 and the non-rotating portion 420 and also prevent discharged fluid from recirculating upstream (in the context of a vertical production well, upstream can be understood to mean downhole). The recirculation isolator can couple to the well completion (subsystem 300) and prevent rotation of the non-rotating portion 420 while the rotating portion 410 rotates. Coupling the recirculation isolator to the well completion (subsystem 300) can also locate (that is, position) the non-rotating portion 420 relative to the well completion (subsystem 300) and prevent axial movement of the non-rotating portion 420 relative to the well completion (subsystem 300). In some implementations, the connecting point 406 is a part of the recirculation isolator. In some implementations, the coupling part 404 is a part of the recirculation isolator. In some implementations, the recirculation isolator includes an anchor with mechanical slips that can stab into an inner diameter of the well completion (such as the stator 302 or the production tubing 128).

The protective sleeve 490 can surround the rotor 402 and can be similar to the protective sleeve 390 lining the inner diameter of the stator 302. The protective sleeve 490 can be metallic or non-metallic. For example, the protective sleeve 490 can be made of carbon fiber or Inconel.

In some implementations, the retrievable string includes an isolation sleeve 492 that can be retrieved from the well 100 together with the retrievable string 400. In some implementations, the isolation sleeve 492 defines an outer surface of the retrievable string 400. When the retrievable string 400 is positioned within the stator 302, the isolation sleeve 492 of the retrievable string 400 can be against or in the vicinity of the protective sleeve 390 of the subsystem 300. In some implementations, the isolation sleeve 492 allows production fluid to flow through the retrievable string 400 through the inner bore of the isolation sleeve 492, but not across the outer surface of the isolation sleeve 492. In some implementations, the volume defined between the isolation sleeve 492 of the retrievable string 400 and the protective sleeve 390 of the subsystem 300 is isolated from production fluids. The isolation sleeve 492 of the retrievable string 400 can prevent the protective sleeve 390 of the subsystem 300 (and the stator 302 of the subsystem 300) from being exposed to production fluids, thereby reducing or eliminating the risk of corrosion and/or erosion of the protective sleeve 390 due to production fluid flow (and in turn, increasing the reliability and operating life of the subsystem 300). The isolation sleeve 492 can be metallic or non-metallic. For example, the isolation sleeve 492 can be made of carbon fiber or Inconel.

In some implementations, the retrievable string 400 includes additional components (such as a thrust bearing target 452 and/or a radial bearing target 454, described later). Components of the retrievable string 400 and components of the subsystem 300 can be cooperatively configured to counteract a mechanical load experienced by the retrievable string 400 during rotation of the rotor 402. In some implementations, the retrievable string 400 includes duplicate components (such as multiple motor rotors 402) that can act together or independently to provide higher output or redundancy to enhance long term operation. In some implementations, multiple retrievable strings 400 can be deployed to act together or independently to provide higher output or redundancy to enhance long term operation.

Figure 5:
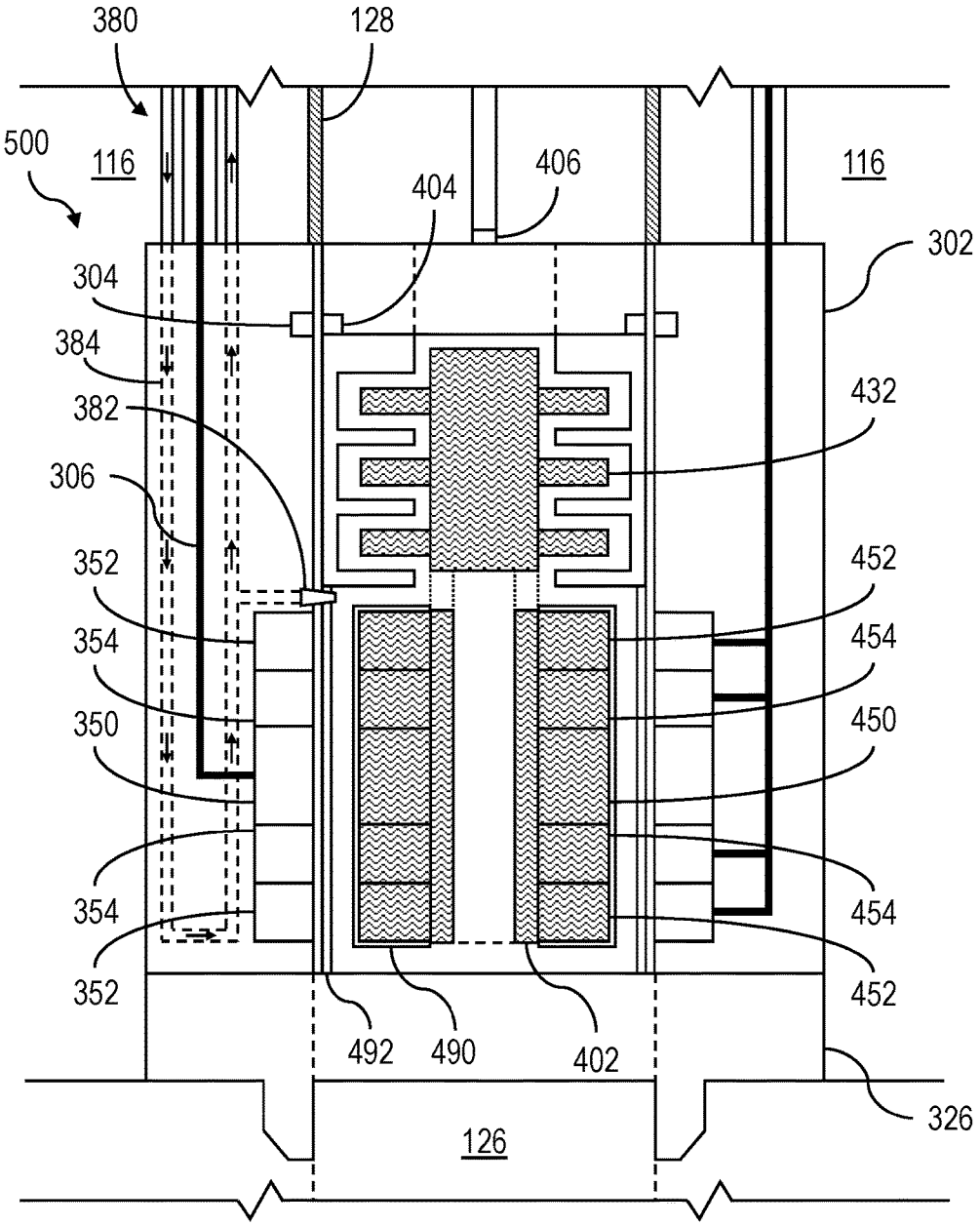
FIG. 5 is a schematic diagram of an example system including an example stator and an example retrievable string.

Referring to FIG. 5, system 500 is an implementation including an implementation of the subsystem 300 and an implementation of the retrievable string 400. The subsystem 300 can include one or more thrust bearing actuators 352. The thrust bearing actuators 352 can be, for example, thrust bearing permanent magnets (passive) or thrust bearing electromagnetic coils (active). In the case of thrust bearing electromagnetic coils, the thrust bearing actuators 352 can be connected to topside circuitry, for example, by a cable running through the annulus 116. The subsystem 300 can include one or more radial bearing actuators 354. The radial bearing actuators 354 can be, for example, radial bearing permanent magnets (passive) or radial bearing electromagnetic coils (active). In the case of radial bearing electromagnetic coils, the radial bearing actuators 354 can be connected to topside circuitry, for example, by the cable running through the annulus 116. In some implementations, the thrust bearing actuators 352 and the radial bearing actuators 352 are connected to a magnetic bearing controller located at the surface 106. The subsystem 300 can include a cooling circuit 380. The arrows represent the flow direction of the coolant circulating in the cooling circuit 380. The configuration of the cooling circuit 380 and the flow direction of the coolant circulating in the cooling circuit 380 can be different from the example shown in FIG. 5.

The retrievable string 400 can include one or more thrust bearing targets 452. The thrust bearing targets 452 can be, for example, metallic stationary poles (solid or laminated), rotating metallic poles (solid or laminated), and/or permanent magnets. The retrievable string 400 can include one or more radial bearing targets 454. The radial bearing targets 454 can be, for example, metallic stationary poles (solid or laminated), rotating metallic poles (solid or laminated), and/or permanent magnets. The thrust bearing targets 452 and the radial bearing targets 454 can both be comprised of stationary components (for example, for conducting magnetic fields in a specific path) and rotating components. For example, the thrust bearing target 452 can include a solid metallic pole that conducts a magnetic field from a stator coil (such as the thrust bearing actuator 352). The magnetic field from the stator coil (352) is radial, and the solid metallic pole (of the thrust bearing target 452) can conduct the radial magnetic field to an axial magnetic field, at which point the magnetic field crosses a gap between a stationary pole and a rotating pole, thereby imparting a force between the stationary pole and the rotating pole. The thrust bearing targets 452 and the radial bearing targets 454 are coupled to the rotor 402 and can be covered by the protective sleeve 490. The protective sleeve 490 can prevent the bearing targets (452, 454) and the motor permanent magnet 450 from being exposed to production fluid.

As shown in FIG. 5 for system 500, the electrical components and electric cables can be reserved for the subsystem 300 which forms a part of the completion string of the well 100, and the retrievable string 400 can be free of electrical components and electric cables. Various components of subsystem 300 (such as the electromagnetic coil 350, the thrust bearing actuators 352, and the radial bearing actuators 354) are sources of magnetic flux and can include electrical components. The generated magnetic fluxes can interact with targets (for example, a permanent magnet) to achieve various results, such as rotation of the rotor 402 in the case of the motor permanent magnet 450, translation in the case of a linear motor, axial levitation of the rotor 402 in the case of thrust bearing targets 452, and radial levitation of the rotor 402 in the case of the radial bearing targets 454.

The thrust bearing actuators 352 and the thrust bearing targets 452 are cooperatively configured to counteract axial (thrust) loads on the rotor 402. The thrust bearing actuators 352 and the thrust bearing targets 452 work together to control an axial position of the rotor 402 relative to the retrievable string 400. For example, the thrust bearing actuators 352 and the thrust bearing targets 452 interact magnetically (that is, generate magnetic fields to exert attractive or repulsive magnetic forces) to maintain an axial position of the rotor 402 relative to the retrievable string 400 while the rotor 402 rotates.

Similarly, the radial bearing actuators 354 and the radial bearing targets 454 are cooperatively configured to counteract radial loads on the rotor 402. The radial bearing actuators 354 and the radial bearing targets 454 work together to control a radial position of the rotor 402 relative to the retrievable string 400. For example, the radial bearing actuators 354 and the radial bearing targets 454 interact magnetically (that is, generate magnetic fields to exert attractive or repulsive magnetic forces) to maintain a radial position of the rotor 402 relative to the retrievable string 400 while the rotor 402 rotates.

In some implementations, the system 200 includes a damper (for example, a passive damper and/or an active damper). The damper includes a stationary portion (which can include electrical components) that can be installed as a part of the subsystem 300. The damper includes a rotating portion (which can include a permanent magnet) that can be installed as a part of the retrievable string 400. A damper magnetic field can be generated by a permanent magnet rotating with the rotor 402. The damper can damp a vibration of the rotor 402. The damper can include a damper magnet positioned between or adjacent to the bearing actuators (352, 354). The vibration of the rotor 402 can induce a vibration in the damper magnet. In some implementations, the damper magnet includes a first damper magnet pole shoe and a second damper magnet pole shoe coupled to a first pole (North) and a second pole (South), respectively. The first damper magnet pole shoe and the second damper magnet pole shoe can maintain uniformity of the magnetic fields generated by the damper magnet. In some implementations, a damper sleeve is positioned over the outer diameters of the damper magnet, the first damper magnet pole shoe, and the second damper magnet pole shoe.

In some implementations, for active dampers, one or more radial velocity sensing coils can be placed in a plane adjacent to the first damper magnet pole shoe and coupled to the first pole of the damper magnet. The one or more radial velocity sensing coils can be installed as a part of the subsystem 300 and be exposed to a magnetic field emanating from the first pole of the damper magnet. Radial movement of the damper magnet can induce an electrical voltage in the one or more radial velocity sensing coils. The damper magnet can face the one or more radial velocity sensing coils with the first pole. In some implementations, a second damper sensing magnet is positioned axially opposite the one or more radial velocity sensing coils and oriented to face the one or more radial velocity sensing coils with a pole opposite the first pole. A printed circuit board can include the one or more radial velocity sensing coils.

For active dampers, one or more radial damper actuator coils can be placed in a second plane adjacent to the second damper magnet pole shoe and coupled to the second pole of the damper magnet. The one or more radial damper actuator coils can be installed as a part of the subsystem 300 and be exposed to a magnetic field emanating from the second pole of the damper magnet. An electrical current in the one or more radial damper actuator coils can cause a force to be exerted on the damper magnet. The damper magnet can face the one or more radial damper actuator coils with the second pole. In some implementations, a second damper sensing magnet is positioned axially opposite the one or more radial damper actuator coils and oriented to face the one or more radial damper actuator coils with a pole opposite the second pole. A printed circuit board can include the one or more radial damper actuator coils.

As shown in FIG. 5 for the system 500, the electrical components of the system 500 are positioned in the portions related to the well completion (subsystem 300), and electric cables run through the annulus 116 which can be filled with completion fluid including corrosion inhibitor. In this way, the electrical components can be isolated from the producing portion of the well 100, which can contain fluids that are potentially damaging to the cables (for example, by corrosion, abrasion, or erosion).

Figure 6:
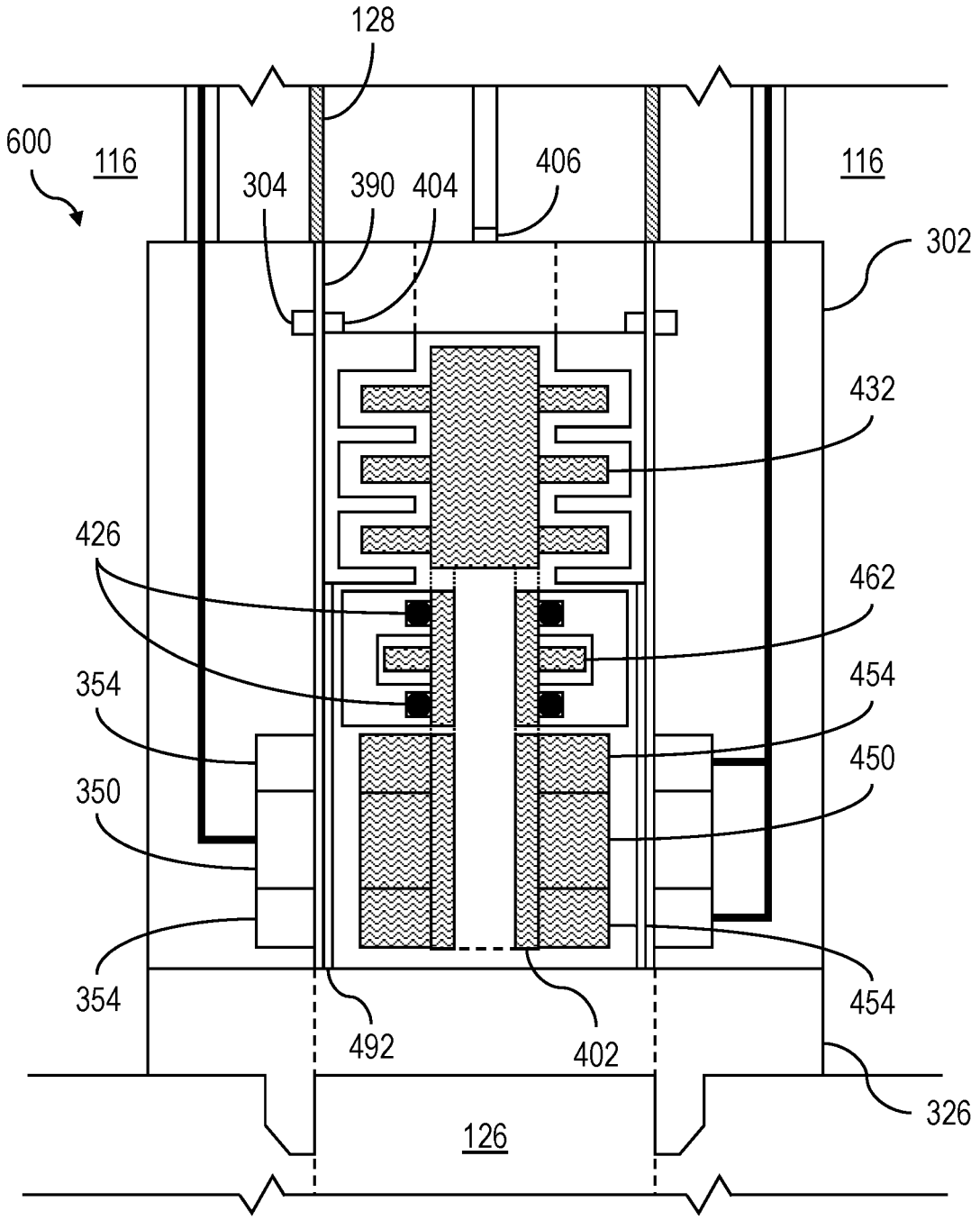
FIG. 6 is a schematic diagram of an example system including an example stator and an example retrievable string.

Referring to FIG. 6, system 600 is an implementation including an implementation of the subsystem 300 and an implementation of the retrievable string 400. The retrievable string 400 can include a protector. The protector can include a thrust bearing 462. As shown in FIG. 6, the thrust bearing 462 can be a mechanical thrust bearing. The thrust bearing 462 can instead be a magnetic thrust bearing with corresponding permanent magnets (not shown) on either side of the thrust bearing 462. The housing of the protector can be connected to or be a part of the non-rotating portion 420 of the retrievable string 400. The shaft running through the protector can be coupled to the rotor 402 and also to the impellers 432, such that the shaft and impellers rotate with the rotating rotor 402. The protector can include face seals 426 that prevent fluid from entering or exiting the protector. The protector can be filled with lubrication fluid (for example, lubrication oil)—that is, the thrust bearing 462 can be submerged in lubrication fluid.

Although not shown, the protector can equalize pressure of the lubrication fluid to a production fluid while keeping the lubrication fluid relatively isolated from contamination by the production fluid for portions of the system 600 that do not need to interact with the production fluid (or would be adversely affected by exposure to the production fluid). The protector can include a flexible material that can expand or contract to equalize pressure within and outside the material to achieve pressure balance. The flexible material can be, for example, a rubber bag, a diaphragm, or a flexible metallic barrier. The flexible material can also serve to provide a barrier or a seal between the lubrication fluid and the production fluid. As the production fluid pressure increases, the flexible material can compress the lubrication fluid until the pressure of the lubrication fluid is equal to that of the production fluid, with no flow of production fluid into the lubrication fluid. The protector can include, in addition to or instead of the flexible material, a labyrinth chamber, which provides a tortuous path for the production fluid to enter the protector and mix with the lubrication fluid. The labyrinth chamber can provide another way to equalize pressure between the production fluid and the lubrication fluid. The lubrication fluid and the production fluid can balance in pressure, and the tortuous path of the labyrinth chamber can prevent downhole fluid from flowing further into the protector. The labyrinth chamber can be implemented for vertical orientations of the system 500. Produced fluid can flow through the annulus defined between the outer surface of the protector and the inner surface of the stator 302 (or the protective sleeve 390). A portion of the protector can be hollow (as shown in FIG. 6), and produced fluid can flow through the hollow portion of the protector.

Figure 7:
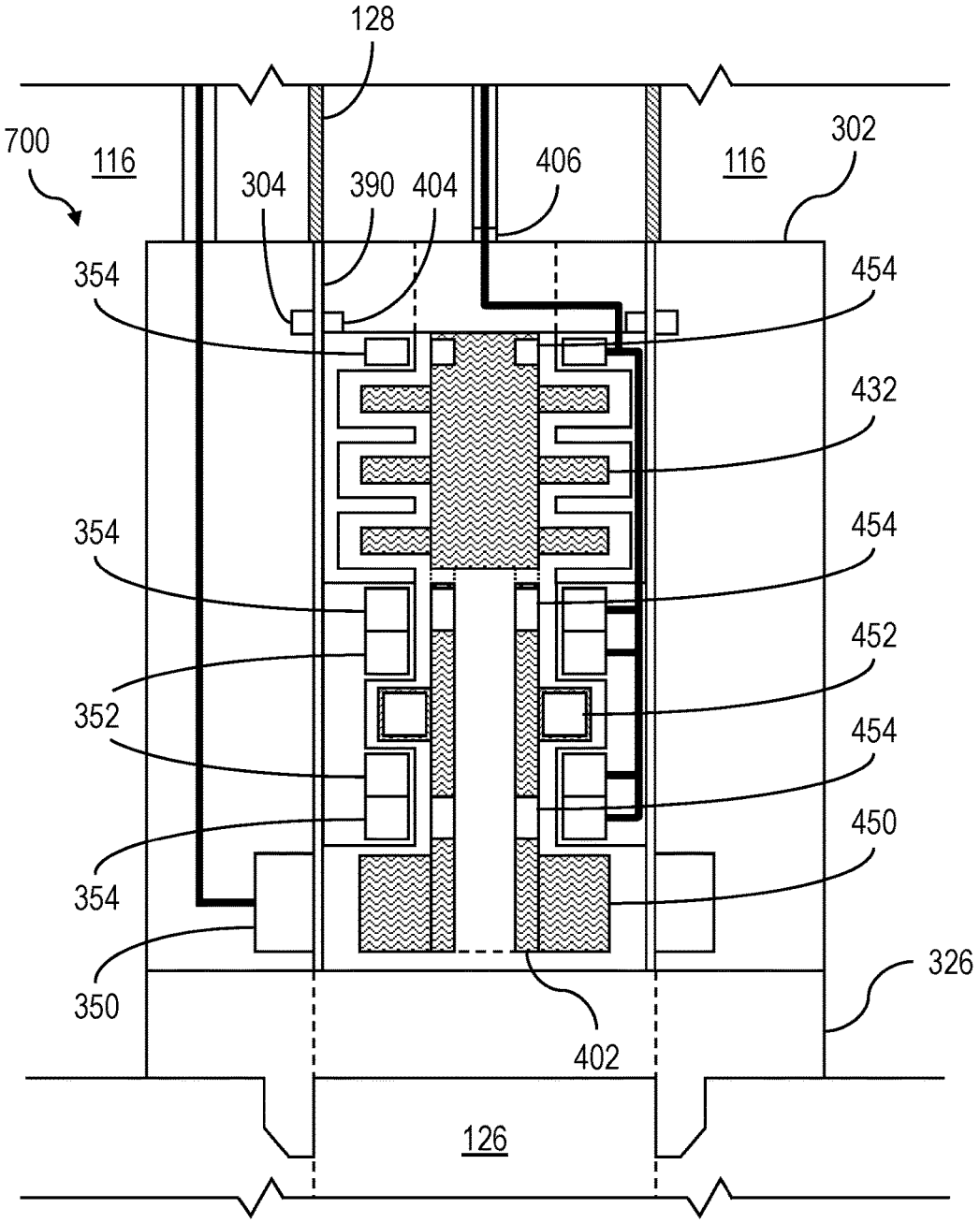
FIG. 7 is a schematic diagram of an example system including an example stator and an example retrievable string.

Referring to FIG. 7, system 700 is an implementation including an implementation of the subsystem 300 and an implementation of the retrievable string 400. The non-rotating portion 420 of the retrievable string 400 can include one or more thrust bearing actuators 352. The thrust bearing actuators 352 can be, for example, thrust bearing permanent magnets (passive) or thrust bearing electromagnetic coils (active). In the case of thrust bearing electromagnetic coils, the thrust bearing actuators 352 can be connected to topside circuitry, for example, by a cable running through the production tubing 128. The non-rotating portion 420 of the retrievable string 400 can include one or more radial bearing actuators 354. The radial bearing actuators 354 can be, for example, radial bearing permanent magnets (passive) or radial bearing electromagnetic coils (active). In the case of radial bearing electromagnetic coils, the radial bearing actuators 354 can be connected to topside circuitry, for example, by the cable running through the production tubing 128. In some implementations, the thrust bearing actuators 352 and the radial bearing actuators 352 are connected to a magnetic bearing controller located at the surface 106.

The rotating portion 410 of the retrievable string 400 can include one or more thrust bearing targets 452. The rotating portion 410 of the retrievable string 400 can include one or more radial bearing targets 454. The thrust bearing targets 452 and the radial bearing targets 454 are coupled to the rotor 402. As described previously, the thrust bearing actuators 352 and the thrust bearing targets 452 are cooperatively configured to counteract axial (thrust) loads on the rotor 402, and the radial bearing actuators 354 and the radial bearing targets 454 are cooperatively configured to counteract radial loads on the rotor 402.

Figure 8:
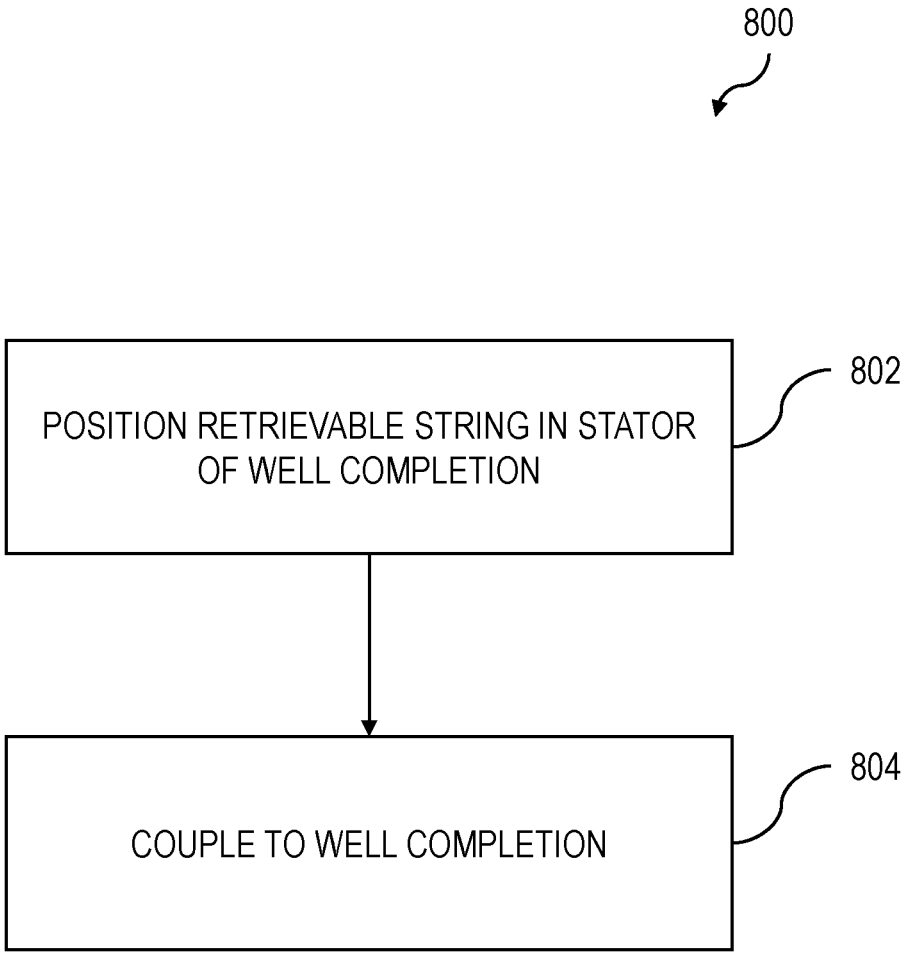
FIG. 8 is a flow chart of an example method applicable to a system including a stator and a retrievable string.

FIG. 8 illustrates steps of a method 800 as a flow chart. At step 802, a retrievable string (such as the retrievable string 400) is positioned in a stator (such as the stator 302) of a completion string installed in a well (such as the well 100). The retrievable string 400 can be positioned in the stator 302 such that the various corresponding components are aligned with each other. For example, the electromagnetic coil 350 of the stator 302 is aligned with the motor permanent magnet 450 of the retrievable string 400. As another example, the thrust bearing actuator 352 is aligned with the thrust bearing target 452. As described previously, the retrievable string 400 includes a rotating portion 410 and a non-rotating portion 420. The rotating portion 410 includes a rotor (such as the rotor 402) and an impeller (such as the impeller 432) coupled to the rotor 402. In some implementations, the rotating portion 410 includes a protective sleeve surrounding the rotor 402 (such as the protective sleeve 490). In some implementations, although the impeller 432 is part of the rotating portion 410 of the retrievable string 400, the impeller 432 resides within the non-rotating portion 420 of the retrievable string 400. As described previously, the retrievable string 400 can include at least one of an electric submersible pump, a compressor, or a blower. The retrievable string 400 can also include a protector.

In some implementations, the stator 302 is installed as part of the completion string in the well 100 before the retrievable string 400 is positioned in the stator 302 at step 802. In some implementations, an annulus between the stator 302 and the well 100 (such as the inner bore 116 between the casing 112 and the production tubing 128) is filled with a completion fluid which includes corrosion inhibitor. The retrievable string 400 can be positioned in the stator 302 using common deployment methods and systems (for example, slickline). In some implementations, the retrievable string 400 is positioned in the stator 302 by applying fluidic pressure on a plug (for example, a low pressure seal) positioned at an uphole end of the retrievable string 400 (this deployment method is sometimes referred as a "pump down" method).

At step 804, the coupling part 404 of the retrievable string 400 is coupled to a corresponding coupling part (such as the coupling part 304) of the completion string. The stator 302 can then be used to drive the rotor 402 of the retrievable string 400 to rotate the impeller 432. In some implementations, the stator 302 includes an electromagnetic coil (such as the electromagnetic coil 350), and the retrievable string 400 includes a motor permanent magnet (such as the motor permanent magnet 450) coupled to the rotor 402. A magnetic field can be generated by the electromagnetic coil 350 of the stator 302 to engage the motor permanent magnet 450 of the retrievable string 400, causing the rotor 402 (and the impeller 432) to rotate. The rotating impeller 432 induces fluid flow within the well 100. In some implementations, one or more properties (such as a property of the well 100, a property of the stator 302, and a property of the retrievable string 400) are determined by a sensor of the stator 302. Various operating parameters can then be adjusted based on the one or more determined properties. For example, the operating speed (rotation speed of the rotor 402) can be adjusted. The one or more determined properties can be used to determine shutdown or impending maintenance issues. The one or more determined properties can be used to assess changes in production fluid properties. The one or more determined properties can be used to assess changes in well characteristics over time.

The stator 302 can include an actuator (such as the thrust bearing actuator 352 or the radial bearing actuator 354), and the retrievable string 400 can include a bearing target (such as the thrust bearing target 452 or the radial bearing target 454). In some implementations, the bearing target includes a bearing permanent magnet. A mechanical load on the rotor 402 can be counteracted by generating a magnetic field using the actuator to engage the bearing target. In some implementations, the mechanical load on the rotor 402 is an axial (thrust) load on the rotor 402. In some implementations, the mechanical load on the rotor 402 is a radial load on the rotor 402. The stator 302 can include additional actuators, and the retrievable string 400 can include additional bearing targets. In some implementations, one or more of the actuators and one or more of the bearing targets are cooperatively configured to counteract axial loads on the rotor 402, while the remaining actuators and the remaining bearing targets are cooperatively configured to counteract radial loads on the rotor 402. Each of the actuators can be one of a thrust bearing electromagnetic coil, a radial bearing electromagnetic coil, a thrust bearing permanent magnet, and a radial bearing permanent magnet.

In the case that the retrievable string 400 requires maintenance, the retrievable string 400 can be decoupled from the completion string and retrieved from the well 100. While the retrievable string 400 is decoupled from the completion string and retrieved from the well 100, the stator 302 can remain in the well 100. The retrievable string 400 can undergo maintenance and re-deployed in the well 100. In some implementations, another retrievable string (the same as or similar to the retrievable string 400) can be deployed in the well following the steps 802 and 804.

Figure 9A:
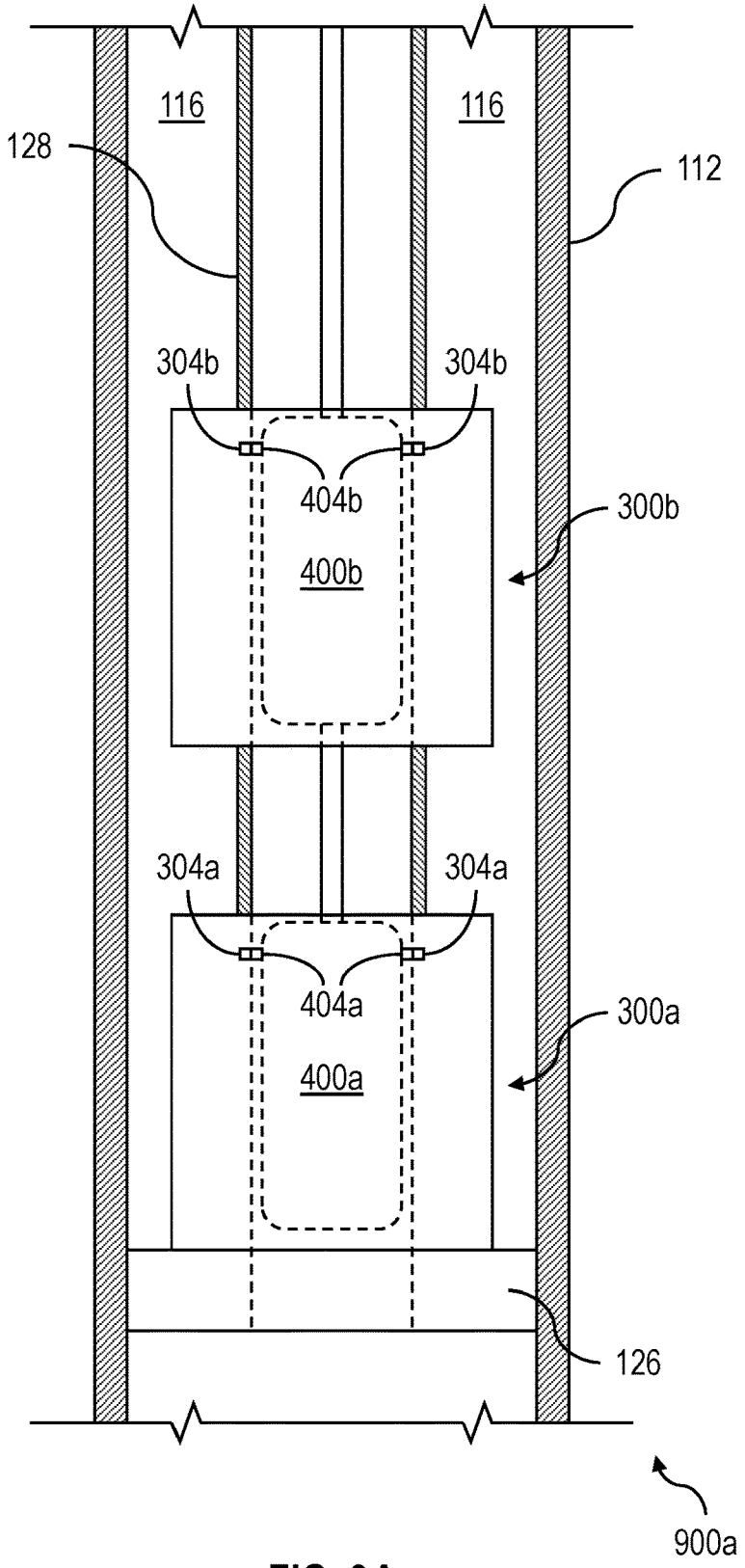
FIGS. 9A, 9B, 9C, and 9D are schematic diagrams of example systems within the well of FIG. 1.

Referring to FIG. 9A, the system 900*a* of FIG. 9A includes a first subsystem 300*a* and a second subsystem 300*b*, separate from each other and positioned at different locations along the production tubing 128. The first subsystem 300*a* and the second subsystem 300*b* can include any of the components that were previously described with respect to the subsystem 300. In some implementations, the first subsystem 300*a* and the second subsystem 300*b* are substantially the same (that is, they include the same components). The system 900*a* includes a first retrievable string 400*a* and a second retrievable string 400*b*. The first retrievable string 400*a* can be positioned within the first subsystem 300*a*, and the second retrievable string 400*b* can be positioned within the second subsystem 300*a*. The first retrievable string 400*a* and the second retrievable string 400*b* can include any of the components that were previously described with respect to the retrievable string 400. In some implementations, the first retrievable string 400*a* and the second retrievable string 400*b* are substantially the same. The first subsystem 300*a* and the first retrievable string 400*a* can be coupled together with the coupling parts 304*a* and 404*a* of the respective systems. The first subsystem 300*a* and the first retrievable string 400*a* can co-operate to induce fluid flow within the well. The second subsystem 300*b* and the second retrievable string 400*b* can be coupled together with the coupling parts 304*b* and 404*b* of the respective systems. The second subsystem 300*b* and the second subsystem 400*b* can co-operate to induce fluid flow within the well.

Figure 9B:
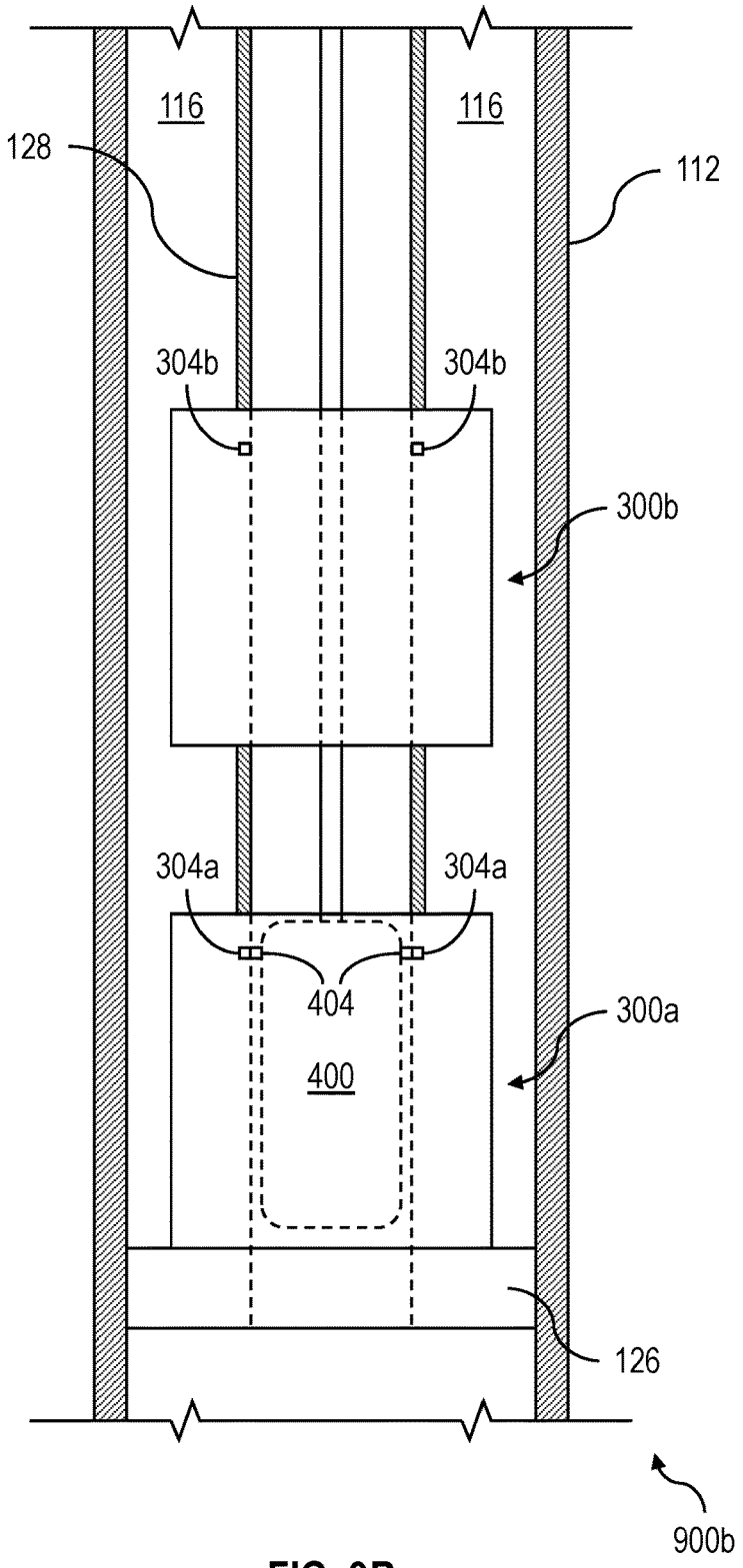

The system 900*b* of FIG. 9B is substantially similar to the system 900*a*. The retrievable string 400 of system 900*b* can co-operate with either the first subsystem 300*a* or the second subsystem 300*b* to induce fluid flow within the well. For example, the retrievable string 400 can be positioned within and coupled to the first subsystem 300*a* with the coupling parts 304*a* and 404 of the respective systems. The retrievable string 400 can co-operate with the first subsystem 300*a* to induce fluid flow at a first location within the well (for example, at the location of the first subsystem 300*a*). The retrievable string 400 can be de-coupled from the first subsystem 300*a* and positioned within and coupled to the second subsystem 300*b* with the coupling parts 304*b* and 404 of the respective systems. The retrievable string 400 can co-operate with the second subsystem 300*b* to induce fluid flow at a second location within the well (for example, at the location of the second subsystem 300*b*).

Figure 9C:
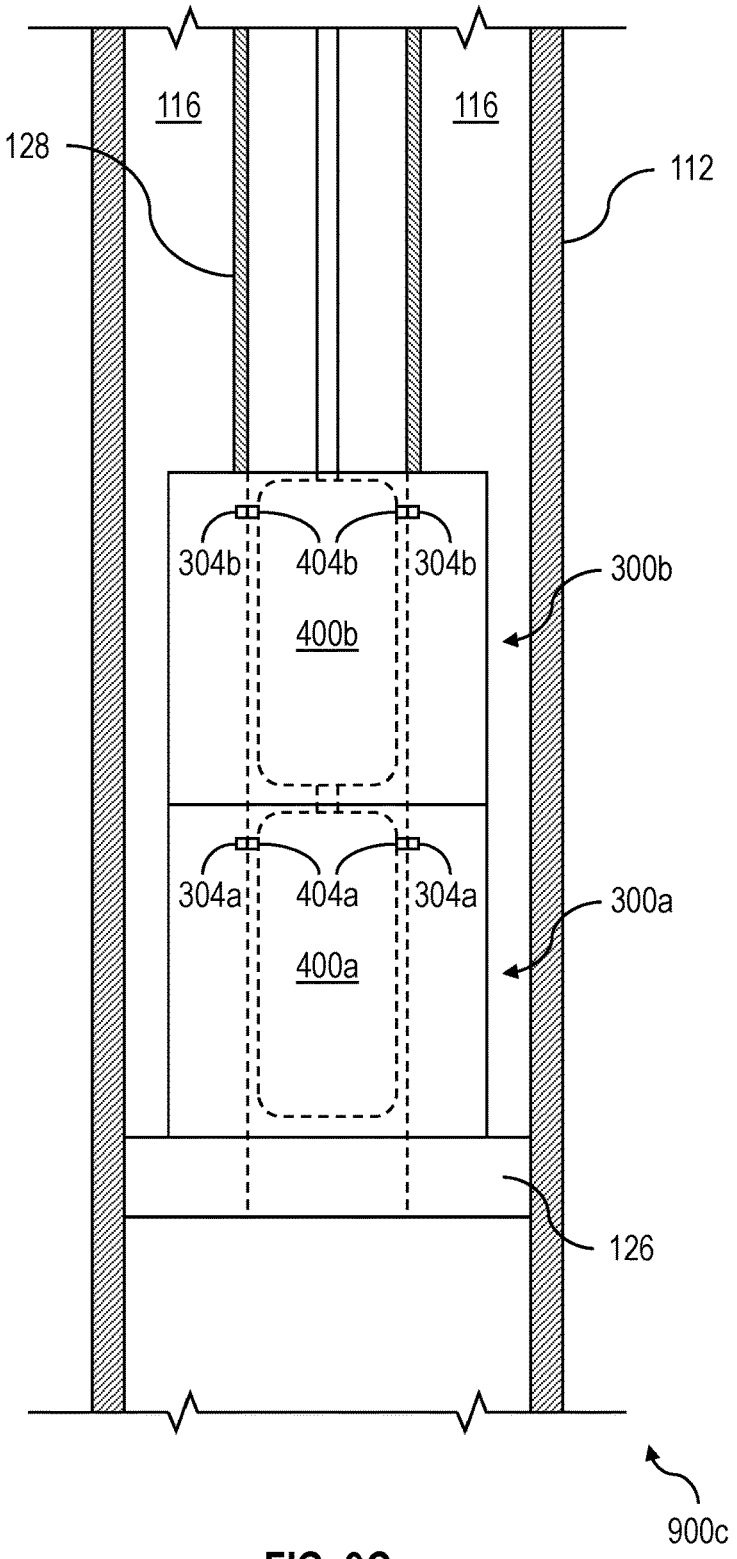
Figure 9D:
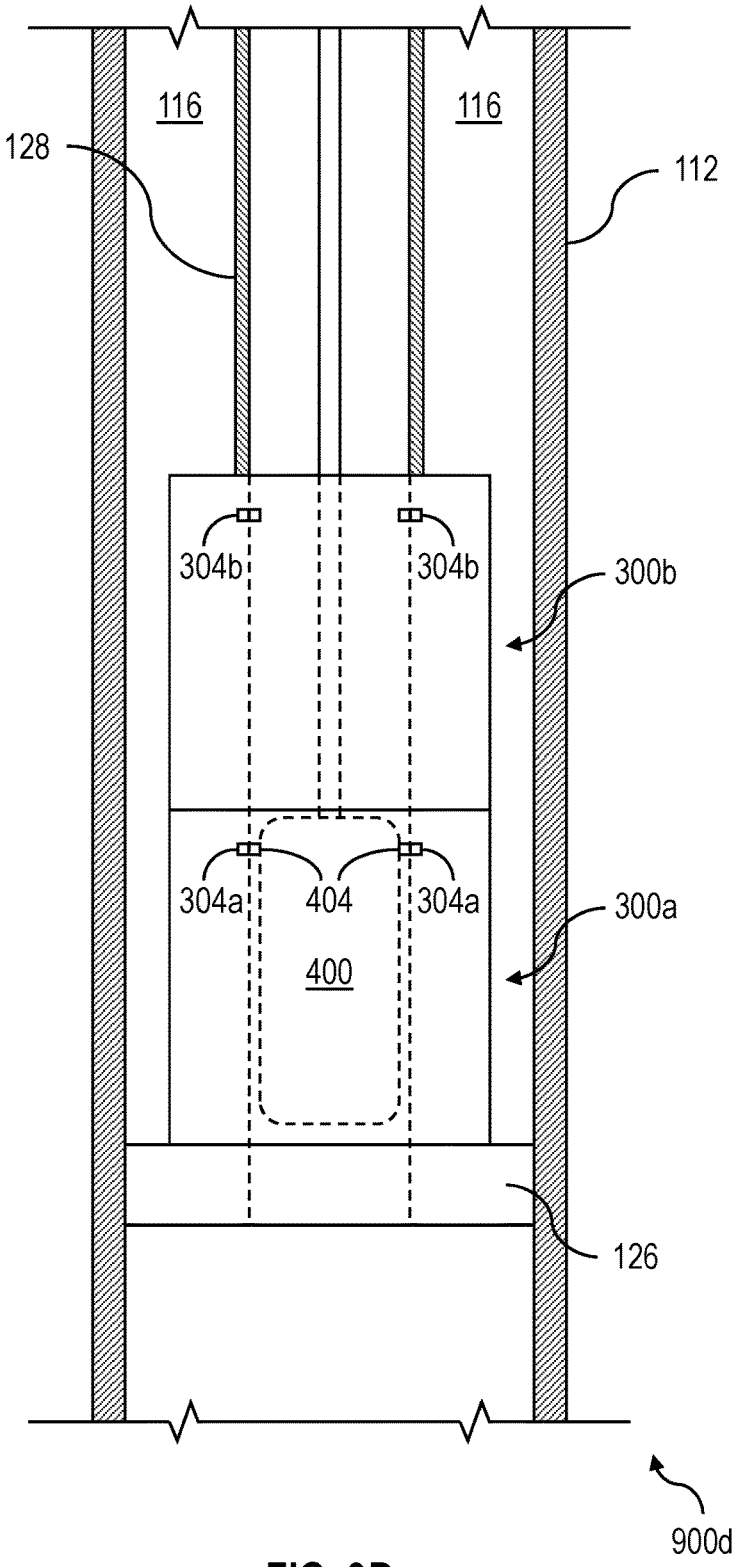

The system 900*c* of FIG. 9C is substantially similar to the system 900*a*, but the first subsystem 300*a* and the second subsystem 300*b* of system 900*c* are connected to each other. The system 900*d* of FIG. 9D is substantially similar to the system 900*b*, but the first subsystem 300*a* and the second subsystem 300*b* of system 900*d* are connected to each other. In such cases, the first subsystem 300*a* and second subsystem 300*b* together can be considered a single subsystem (for example, the subsystem 300). For example, the stator of the first subsystem 300*a* and the stator of the second subsystem 300*b* can each be considered sub-stators of the overall subsystem.

Although systems 900*a* and 900*c* are shown in FIGS. 9A and 9C (respectively) as having two subsystems (300*a*, 300*b*) and two retrievable strings (400*a*, 400*b*), the systems 900*a* and 900*c* can optionally include additional subsystems (for example, the same as or similar to the subsystem 300) and additional retrievable strings (for example, the same as or similar to the retrievable string 400), each of which can be either connected to each other or positioned at different locations in the well 100. Although systems 900*b* and 900*d* are shown in FIGS. 9B and 9D (respectively) as having two subsystems (300*a*, 300*b*) and one retrievable string (400), the systems 900*b* and 900*d* can optionally include additional subsystems (for example, the same as or similar to the subsystem 300) and additional retrievable strings (for example, the same as or similar to the retrievable string 400), each of which can be either connected to each other or positioned at different locations in the well 100.

In this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

In this disclosure, "approximately" means a deviation or allowance of up to 10 percent (%) and any variation from a mentioned value is within the tolerance limits of any machinery used to manufacture the part. Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise. "About" can allow for a degree of variability in a value or range, for example, within 10%, within 5%, or within 1% of a stated value or of a stated limit of a range.

While this disclosure contains many specific implementation details, these should not be construed as limitations on the scope of the subject matter or on the scope of what may be claimed, but rather as descriptions of features that may be specific to particular implementations. Certain features that are described in this disclosure in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination. For example, although a protector is only shown in the system 600 of FIG. 6, a protector can also be included in other implementations, such as the retrievable string 400, the system 500, and the system 700. As another example, although the cooling circuit 380 is only shown in the system 500 of FIG. 5, the cooling circuit 380 can also be included in other implementations, such as the subsystem 300, the system 600, and the system 700. As another example, although the systems 500, 600, and 700 shown in FIGS. 5, 6, and 7, respectively, show electromagnetic coils for various thrust bearings and radial bearings, the systems can include, in addition to or instead of the electromagnetic coils, permanent magnets for the same purpose.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results.

Accordingly, the previously described example implementations do not define or constrain this disclosure. Other changes, substitutions, and alterations are also possible without departing from the spirit and scope of this disclosure.

What is claimed is:

1. A retrievable string configured to be positioned in a well, the retrievable string comprising:

a rotating portion comprising:

a rotor configured to be positioned in and driven by a stator of a well completion;

an impeller coupled to the rotor and configured to be positioned uphole of the rotor when the retrievable string is positioned in the well; and a bearing target configured to magnetically couple to an actuator installed as part of the stator of the well completion, the bearing target configured to counteract a mechanical load on the rotor in response to a first magnetic field generated by the actuator of the stator of the well completion;

a non-rotating portion surrounding at least part of the rotating portion, the non-rotating portion cooperatively configured with the impeller to induce fluid flow in the well in response to the stator driving the rotor, the non-rotating portion comprising a coupling part configured to support the rotor positioned in the stator, the coupling part configured to detachably couple to a corresponding coupling part of the well completion.

2. The retrievable string of claim 1, wherein the retrievable string is configured to be exposed to production fluid from the well.

3. The retrievable string of claim 2, wherein the retrievable string is configured to allow the production fluid from the well to flow over an outer surface of the rotor.

4. The retrievable string of claim 2, wherein the retrievable string is configured to allow the production fluid from the well to flow through an inner bore of the rotor.

5. The retrievable string of claim 1, further comprising a connecting point positioned at an uphole end of the retrievable string, the connecting point configured to be connected to a connection from a surface location, allowing the retrievable string to be retrieved from the well.

6. The retrievable string of claim 5, wherein the connecting point is configured to be connected to an electrical connection to transmit signals between the surface location and a sensor of the non-rotating portion.

7. The retrievable string of claim 5, wherein the rotor comprises a protective sleeve surrounding at least a portion of the rotor, the protective sleeve configured to isolate the portion of the rotor from production fluid.

8. The retrievable string of claim 7, wherein the protective sleeve is non-metallic.

9. The retrievable string of claim 7, wherein the protective sleeve is metallic.

10. The retrievable string of claim 7, further comprising an isolation sleeve defining an outer surface of the retrievable string, the isolation sleeve configured to isolate production fluid flowing through the retrievable string from the stator of the well completion.

11. The retrievable string of claim 10, wherein the isolation sleeve is non-metallic.

12. The retrievable string of claim 10, wherein the isolation sleeve is metallic.

13. The retrievable string of claim 7, wherein the stator comprises an electromagnetic coil configured to generate a second magnetic field, and the retrievable string comprises a motor permanent magnet configured to cause the rotor to rotate in response to the second magnetic field generated by the electromagnetic coil.

14. The retrievable string of claim 13, wherein the stator is a first stator, and the well completion comprises a second stator independently configured to drive the rotor.

15. The retrievable string of claim 14, wherein the rotor is a first rotor, and the retrievable string further comprises a second rotor configured to be positioned in and driven by the second stator of the well completion.

16. The retrievable string of claim 13, wherein the bearing target comprises a permanent magnet configured to counteract a radial load on the rotor in response to the first magnetic field generated by the actuator.

17. The retrievable string of claim 13, wherein the bearing target comprises a permanent magnet configured to counteract an axial load on the rotor in response to the first magnetic field generated by the actuator.

18. The retrievable string of claim 13, further comprising at least one of an electric submersible pump, a compressor, or a blower.

19. The retrievable string of claim 13, further comprising a plug positioned at the uphole end of the retrievable string, the plug configured to allow the retrievable string to be pumped down into the well.

20. The retrievable string of claim 13, further comprising a cable configured to connect to the connecting point, the cable configured to extend to lower the retrievable string into the well and configured to retract to retrieve the retrievable string from the well.

21. The retrievable string of claim 13, further comprising a mechanical bearing configured to counteract a mechanical load of the rotor.

22. The retrievable string of claim 21, wherein the mechanical bearing is a mechanical thrust bearing configured to counteract an axial load of the rotor.

23. The retrievable string of claim 21, wherein the mechanical bearing is a mechanical radial bearing configured to counteract a radial load of the rotor.

24. The retrievable string of claim 23, wherein the protector comprises:

lubrication fluid; and seals at opposing ends of the protector, the seals configured to prevent fluid from entering and exiting the protector.

25. The retrievable string of claim 24, wherein the connecting point is configured to be connected to a lubrication fluid connection to receive lubrication fluid from the surface location and replenish lubrication fluid in the protector.

26. The retrievable string of claim 21, wherein the mechanical bearing is exposed to production fluid from the well.

27. The retrievable string of claim 21, further comprising a protector, wherein the mechanical bearing is positioned in the protector.

* * * * *